US008752646B2

(12) United States Patent
Fujiwara et al.

(10) Patent No.: US 8,752,646 B2
(45) Date of Patent: Jun. 17, 2014

(54) OPERATING MOTOR SWITCH FOR ELECTRIC POWER TOOL

(75) Inventors: Masahiro Fujiwara, Ibaraki (JP); Nobuhiro Hosokawa, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 589 days.

(21) Appl. No.: 13/005,788

(22) Filed: Jan. 13, 2011

(65) Prior Publication Data

US 2011/0168422 A1 Jul. 14, 2011

(30) Foreign Application Priority Data

Jan. 13, 2010 (JP) ..... P2010-004972

(51) Int. Cl.
*B25F 5/00* (2006.01)

(52) U.S. Cl.
USPC ..... 173/217; 200/43.16; 200/43.17; 200/43.18; 310/50

(58) Field of Classification Search
USPC ..... 173/217; 200/318, 325, 43.16, 43.17, 200/43.18, 332.2, 334; 310/50
See application file for complete search history.

(56) References Cited

U.S. PATENT DOCUMENTS

| | | | | | |
|---|---|---|---|---|---|
| 1,502,169 | A | * | 7/1924 | Bennett | 173/217 |
| 1,929,662 | A | * | 10/1933 | Wappat | 200/332.2 |
| 2,072,551 | A | * | 3/1937 | Forss | 173/217 |
| 3,632,936 | A | * | 1/1972 | Piber | 200/1 V |
| 3,847,233 | A | * | 11/1974 | Glover et al. | 173/170 |
| 4,018,292 | A | | 4/1977 | Roll et al. | |
| 4,922,069 | A | * | 5/1990 | Huizenga | 200/334 |
| 4,973,807 | A | * | 11/1990 | Stabler et al. | 200/321 |
| 5,407,381 | A | | 4/1995 | Schaefer et al. | |
| 7,322,427 | B2 | * | 1/2008 | Shimma et al. | 173/48 |
| 7,498,526 | B2 | | 3/2009 | Lohr et al. | |
| 2005/0196273 | A1 | | 9/2005 | Nishikawa et al. | |
| 2007/0256914 | A1 | | 11/2007 | Lohr et al. | |

FOREIGN PATENT DOCUMENTS

| | | | | | |
|---|---|---|---|---|---|
| CN | 2539269 | Y | | 3/2003 | |
| CN | 101001721 | A | | 7/2007 | |
| JP | 62-118328 | U | | 7/1987 | |
| JP | 2002-150878 | A | | 5/2002 | |
| JP | 2002270066 | A | * | 9/2002 | H01H 21/22 |
| JP | 2005-246542 | A | | 9/2005 | |
| JP | 3115014 | U | | 9/2005 | |
| JP | 2008-119755 | A | | 5/2008 | |
| JP | 2009-285812 | A | | 12/2009 | |

OTHER PUBLICATIONS

The Chinese Office Action for the related Chinese Patent Application No. 201110021071.6 dated Aug. 30, 2013.
Japanese Office Action for the related Japanese Patent Application No. 2010-004972 dated Oct. 9, 2013.

* cited by examiner

*Primary Examiner* — Michelle Lopez
(74) *Attorney, Agent, or Firm* — Kenealy Vaidya LLP

(57) ABSTRACT

An electric power tool includes: a motor; a housing receiving the motor; a power transmission mechanism configured to transmit a driving force of the motor to rotate a top tool; a snap switch including a swing type lever configured to turn on or off rotation of the motor, the snap switch being received inside the housing; a switch lever configured to move in a direction substantially vertical to a surface of the housing; a push bar configured to move the swing type lever in conjunction with the movement of the switch lever; and an urging unit configured to urge the push bar in a direction in which the switch is turned off.

13 Claims, 9 Drawing Sheets

OPERATING MOTOR SWITCH FOR ELECTRIC POWER TOOL

BACKGROUND

The present disclosure relates to an electric power tool for performing on-off control of a motor by gripping a switch lever disposed in a grip, and particularly to the electric power tool for improving a switch mechanism.

As an example of a portable electric power tool, a disk grinder is known as described in JP-A-2005-246542. FIG. 13 is a sectional view showing the whole structure of a related disk grinder. A disk grinder 101 has a cylindrical motor housing 102 for receiving a motor 106 which is a driving source. A tail cover 103 of a left and right division type is disposed in the back of the motor housing 102, and a power cord 117 is connected from the tail cover 103 to the outside. A gear cover 104 for receiving a power transmission mechanism configured to include two sets of bevel gears 108, 109 for converting a power transmission direction by a rotating shaft of the motor by about 90° is disposed in the front of the motor housing 102. A grindstone 105 is attached to a spindle 110 which is connected to the bevel gear 109 and downward protrudes from the gear cover 104.

A switch mechanism for turning on and off the motor 106 is disposed under the tail cover 103. The switch mechanism is configured to include a switch 115, a switch lever 121 for pushing a plunger 115*a* of the switch 115 and an off-lock lever 123 for holding the switch lever 121 in a constant state. The switch lever 121 can swing around a turning shaft 125 by a minute angle, and a worker grips the tail cover 103 together with the switch lever 121 and thereby, the switch lever 121 swings in a direction of arrow 131 in the drawing. When the switch lever 121 swings, a push bar part 121*a* which is disposed integrally to the switch lever 121 and is opposed to the plunger 115*a* pushes the plunger 115*a* and thereby, the switch 115 changes to an on state. In order to turn off rotation of the motor 106, the worker releases the switch lever 121 and thereby, the switch lever 121 returns to the original position (a position shown in FIG. 13) by action of a spring 126.

In recent years, international standards for electric power tools require safety measures in which the switch lever 121 can be gripped only when some action is taken so that the motor 106 does not rotate by only gripping the switch lever 121. Because of that, the disk grinder 101 is constructed so that the off-lock lever 123 capable of sliding backward and forward is disposed in the vicinity of substantially the center of the switch lever 121 and the switch lever 121 can be moved in the direction of arrow 131 in only a state of sliding this off-lock lever 123 in a direction of arrow 132 (the front). As a result, a protrusion 123*a* (see FIG. 14) is disposed in the off-lock lever 123 and a rib 133 is disposed in the opposed portion of the tail cover 103. In a state in which the worker does not touch the switch lever 121, the off-lock lever 123 is positioned backward (a direction opposite to the arrow 132) by action of a spring 124 and in this case, the protrusion 123*a* runs on the rib 133, so that the switch lever 121 cannot be moved in the direction of arrow 131.

When the worker grips the switch lever 121, the off-lock lever 123 is first moved in the direction of arrow 132 and the switch lever 121 is gripped with a moved state held and the switch lever 121 is swung in the direction of arrow 131. A state of gripping this switch lever 121 is shown in FIG. 14. In the state of gripping the switch lever 121, the switch lever 121 swings around the turning shaft 125 clockwise and the switch lever 121 abuts on a lower surface of the tail cover 103. In this case, the off-lock lever 123 is moved forward while compressing the spring 124, so that a state of abutting of the protrusion 123*a* on the rib 133 is released. By sliding the off-lock lever 123 thus, the switch lever 121 can swing around the turning shaft 125 and the push bar part 121*a* pushes the plunger 115*a* and thereby, the switch 115 can be turned on.

When the switch 115 is turned on, AC electric power is supplied to the motor 106 through the switch 115 and a rotor rotates and thereby, the grindstone 105 is rotated and intended work can be done. In this case, a cooling fan 107 disposed in a rotating shaft 106*a* of the motor 106 rotates and an airflow for cooling of the motor 106 is generated inside the motor housing 102. In order to turn off the switch 115, when the worker releases a grip of the switch lever 121, the switch lever 121 returns to the state of FIG. 13 by a repulsive force of the spring 126 and the switch 115 is turned off.

As described above, the conventional disk grinder 101 is constructed so that a spring force is always applied to the switch lever 121 to the off side by the spring 126 and similarly a spring force is always applied to the off-lock lever 123 to the off side by the spring 124 and the switch 115 cannot be turned on by being disturbed by the rib 133 disposed in the tail cover 103 even when the switch lever 121 is gripped simply. Then, when the off-lock lever 123 is slid forward against the spring force of the spring 124, the switch 115 can be turned on by being released from an obstacle of the rib 133.

SUMMARY

In recent years, the electric power tools require reductions in size, weight and cost while power of the motor improves by a request for an increase in work efficiency of the worker, and the applicant has implemented various electric power tools with this change. On the other hand, the applicant has attempted to achieve an increase in performance and ensuring of sufficient safety while improving the reductions in size, weight and cost. An improvement in cooling efficiency of the motor while ensuring safety is an important problem, and it has become difficult to ensure and enlarge an air intake port for motor cooling in the case of improving the reductions in size and weight.

The exemplary embodiment has been implemented in view of the background described above, and an object of the invention is to provide an electric power tool capable of implementing a switch mechanism for turning on and off a motor at low cost.

Another object of an aspect of the exemplary embodiment is to provide the electric power tool for increasing safety by disposing an off-lock function in the switch mechanism for turning on and off the motor.

A further object of the aspect of the exemplary embodiment is to provide the electric power tool for improving a cooling air passage structure for cooling the motor.

The aspect of the exemplary embodiment provides the following arrangements.

An electric power tool comprising:

a motor;

a housing receiving the motor;

a power transmission mechanism configured to transmit a driving force of the motor to rotate a top tool;

a snap switch including a swing type lever configured to turn on or off rotation of the motor, the snap switch being received inside the housing;

a switch lever configured to move in a direction substantially vertical to a surface of the housing;

a push bar configured to move the swing type lever in conjunction with the movement of the switch lever; and an urging unit configured to urge the push bar in a direction in which the switch is turned off.

An electric power tool comprising:

a motor;

a housing receiving the motor, the housing defining a front side and a back side;

a gear cover connected to the front side of the housing;

a spindle which protrudes from the gear cover, is rotated and driven by the motor and is configured to hold a top tool;

a snap switch received in the housing and disposed at the back side of the housing; and a switch lever which extends in a direction from the front side to the back side of the housing and is configured to turn with respect to the housing to operate the snap switch.

An electric power tool comprising:

a motor;

a housing receiving the motor, the housing defining a front side and a back side;

a gear cover connected to the front side of the housing;

a spindle which protrudes from the gear cover, is rotated and driven by the motor and is configured to hold a top tool;

a switch which is received in the housing and is disposed at the back side of the housing; and a switch lever which includes a front end supported in the housing, the switch lever configured to turn using the front end as a turn fulcrum to operate the switch, wherein the switch lever is provided with an off-lock lever which contacts the housing in a first position and does not contact the housing in a second position, and the first position is closer to the back side of the housing than the second position.

An electric power tool comprising:

a motor;

a housing receiving the motor, the housing defining a front side and a back side;

a gear cover connected to the front side of the housing, a spindle which protrudes from the gear cover, is rotated and driven by the motor and is configured to hold a top tool;

a switch received in the housing and disposed at the back side of the housing; a lever which backward extends from the switch; and a switch lever including a front end supported in the housing, the switch lever configured to turn using the front end as a turn fulcrum and operate the lever.

An electric power tool comprising:

a motor;

a housing receiving the motor, the housing defining a front side and a back side;

a gear cover connected to the front side of the housing;

a spindle which protrudes from the gear cover and is rotated and driven by the motor and can hold a top tool;

a switch received in the housing and disposed at the back side of the housing;

a switch lever supported in the housing and configured to turn with respect to the housing to operate the switch; and an urging member configured to urge the switch and disposed between the housing and the switch lever.

DETAILED DESCRIPTION OF EXEMPLARY EMBODIMENTS

First Embodiment

Figure 1:
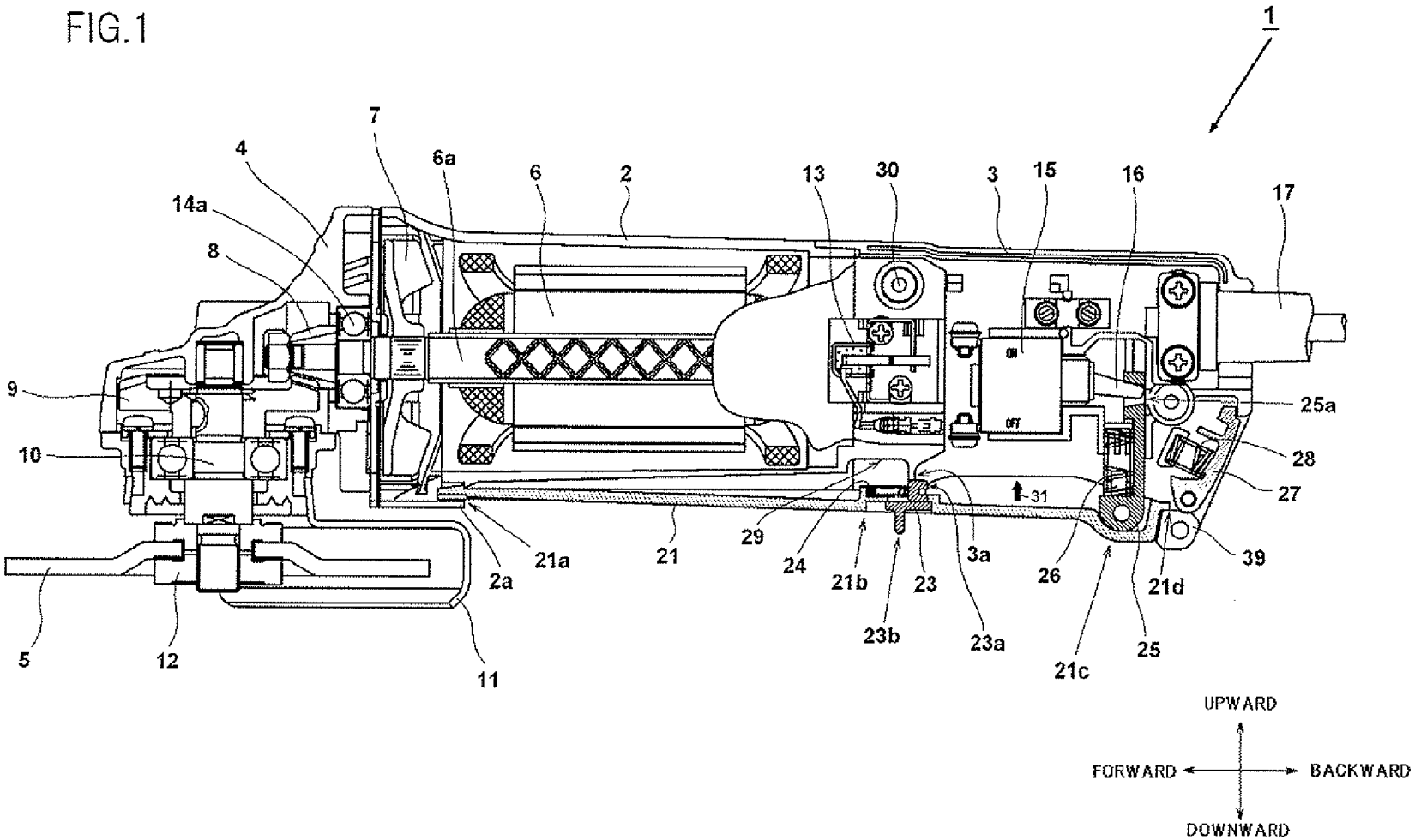
FIG. 1 is a sectional view showing the whole configuration of a disk grinder 1 according to an embodiment of the invention.

Exemplary embodiments will hereinafter be described based on the drawings. In addition, in the following drawings, the same numerals are assigned to the same portions and the repetitive description is omitted. In the present specification, forward and backward, and upward and downward directions are described as the directions shown in the drawings.

FIG. 1 is a sectional view showing the whole configuration of a disk grinder 1 according to the exemplary embodiment. A housing of the disk grinder 1 is constructed by three main portions of a cylindrical motor housing 2 for receiving a motor 6 in the inside, a tail cover 3 attached to the back of the motor housing 2 and a gear cover 4 attached to the front of the motor housing 2. The gear cover 4 receives a power transmission mechanism configured to include two sets of bevel gears 8, 9 for converting a power transmission direction by a rotating shaft 6*a* of the motor 6 by about 90°. The gear cover 4 is attached to the motor housing 2 by, for example, plural screws (not shown) inserted in the back direction from the front. A grindstone 5 is attached to the top of a spindle 10 disposed inside the gear cover 4 and by the two bevel gears 8, 9 accommodated in the gear cover 4, rotation of the motor 6 is decelerated at a predetermined ratio and the grindstone 5 rotates.

The grindstone 5 can be attached to and detached from the spindle 10 by a nut 12. The grindstone 5 is, for example, a sanding disk, a resinoid grindstone, a flexible grindstone or a resinoid flexible grindstone with a diameter of 100 mm, and surface grinding and profile grinding of metal, synthetic resin, marble, concrete, etc. can be performed by selection of a kind of used abrasive grains. A rotational speed of the grindstone 5 is, for example, a maximum of 4300 rpm, and the rotational speed could properly be set according to a work target. A wheel guard 11 is provided for protecting a worker from scattering of ground members, broken abrasive grains, etc.

As the motor 6, a universal motor operating on AC is used in the present embodiment, but the motor is not limited to this motor, and other type motors such as a DC motor or a brushless DC motor may be used. The motor 6 is arranged so as to pack into the motor housing 2 manufactured by integral molding of polymeric resin such as polycarbonate. The motor housing 2 having a cylindrical shape or a long tube shape can have high strength.

The rotating shaft 6*a* of the motor 6 is rotatably held by a bearing 14*a* fixed to the gear cover 4 and bearings (not shown) fixed to the motor housing 2. A cooling fan 7 is disposed in the front side of the motor 6 of the rotating shaft 6*a*. The cooling fan 7 is, for example, a centrifugal fan of made of plastic. By rotation of the cooling fan 7 in synchronization with the motor 6, the outside air is sucked from an intake port (not shown) disposed in a side surface of the tail cover 3 and an airflow passing through the motor 6 is generated and the air is forward exhausted from an exhaust port (not shown) disposed in the gear cover 4.

The tail cover 3 is divided and constructed by a right tail cover and a left tail cover, and these covers are coupled by plural screws 30 (only one screw in the drawing). By forming plural screw bosses 39 having screw holes in the right tail cover 3 and screwing the screws 30 into screw holes formed in the left tail cover 3, the right and left sides of the tail cover are fixed to the motor housing 2. A power cord 17 for supplying electric power to the motor 6 is connected to the outside of the tail cover 3. A switch 15 and a brush holding part 13 for rotating the motor 6 are received inside the tail cover 3. The brush holding part 13 is fixed to the motor housing 2. The switch 15 turns on and off supply of electric power from the power cord 17 to the motor 6, and a toggle switch having a swing type lever 16 is used in the embodiment. The toggle switch is a switch capable of holding the status quo after operation of the lever, and may be called a snap switch. Since the toggle switch is relatively inexpensive unlike a push button switch which is in an on state only when a plunger is pressed, a manufacturing cost can be reduced.

The lever 16 for operation of the switch 15 is arranged so as to extend from the switch 15 backwardly. The switch 15 is turned on when the lever 16 is operated to the upper side, and the switch 15 is turned off when the lever 16 is operated to the lower side. FIG. 1 shows the state in which the lever 16 is located in the lower side and the switch 15 is turned off. A push bar 25 for moving in the upward and downward directions is arranged in the vicinity of the top of the lever 16, and the lever 16 is arranged inside a hole part 25*a* fanned in the push bar 25. With such a positional relation, when the push bar 25 moves to the upper side, the lever 16 is swung to the upper side and the switch 15 is turned on and when the push bar 25 moves to the lower side, the lever 16 is swung to the lower side and the switch 15 is turned off. A spring 26 which is an urging unit is disposed between the push bar 25 and a rib disposed inside the tail cover 3, and the push bar 25 is always urged so as to move to the lower side by the spring 26.

A switch lever 21 for moving the push bar 25 is disposed in the lower side of the motor housing 2 and the tail cover 3. The switch lever 21 is an elongated bar member extending in substantially parallel with the housing portions (2, 3), and a top part 21*a* (front side) is arranged between the motor housing 2 and a lip part 2*a*, and the back side engages with the lower side of the push bar 25. A hinge-shaped portion for protruding in a direction (upward direction) perpendicular to a direction (forward direction) of the top is formed in the top part 21*a* of the switch lever 21. On the other hand, a portion for protruding in the opposite direction (downward direction) is formed in a portion, of the motor housing 2, opposed to the protruding portion of the top part 21*a*, and the lip part 2*a* is disposed in the outer peripheral side of the motor housing 2, and the switch lever 21 is positioned between the protruding portion and the lip part 2*a*, and the switch lever 21 is held so as not to be detached. An engaging part 21*c* formed in a curved surface shape in order to make good contact with the push bar 25 is formed in the back end side of the switch lever 21. A fold back part 21*d* is formed in the back end side of the engaging part 21*c* and the fold back part 21*d* abuts on an upper surface of the screw boss 39 and thereby, the switch lever 21 is held so as not to be detached from the housing portions (2, 3).

The switch lever 21 swings in a direction of arrow 31 and its opposite direction using the top side (left end side) as a fulcrum. A swing angle of the switch lever 21 is about 5° and the switch lever 21 moves in a direction substantially vertical to a bottom surface of the housing portions (2, 3). An off-lock lever 23 is disposed in the vicinity of the center of the forward and backward directions of the switch lever 21. The off-lock lever 23 is provided for stably holding an off state of the switch 15 and limiting movement of the switch lever 21 so as not to turn on the switch 15 easily because of an operation mistake. The off-lock lever 23 is attached movably in the forward and backward directions in a hole part 21*b* disposed in the switch lever 21. This off-lock lever 23 sets a limit so that the switch lever 21 can move in the direction of arrow 31 in only a forward sliding state. For this purpose, in the off-lock lever 23, a protrusion 23*a* is disposed in the upper side and a rib 3*a* is disposed in the opposed portion of the tail cover 3. In a state in which a worker does not touch the switch lever 21, the off-lock lever 23 is positioned always backward (an initial position, a first position) by action of a spring 24 and in this case, the protrusion 23*a* runs on the rib 3*a*, so that the switch lever 21 cannot be moved in the direction of arrow 31.

When the worker grips the switch lever 21, the off-lock lever 23 is first moved forward (an unlocked position, a second position) and the switch lever 21 is gripped with a moved state held and the switch lever 21 is moved in the direction of arrow 31. In the state of gripping the switch lever 21, the switch lever 21 slightly swings around the front end counterclockwise and the switch lever 21 abuts on the rib 3*a* formed on a lower surface of the tail cover 3. Since a recess 29 is formed in the front side of the rib 3*a* and the lower surface of the tail cover 3, the protrusion 23*a* is received in the recess 29 and thereby the switch lever 21 can be gripped. Thus, the switch lever 21 can swing (turn) with respect to the motor housing 2 around the top part 21*a*.

Figure 2:
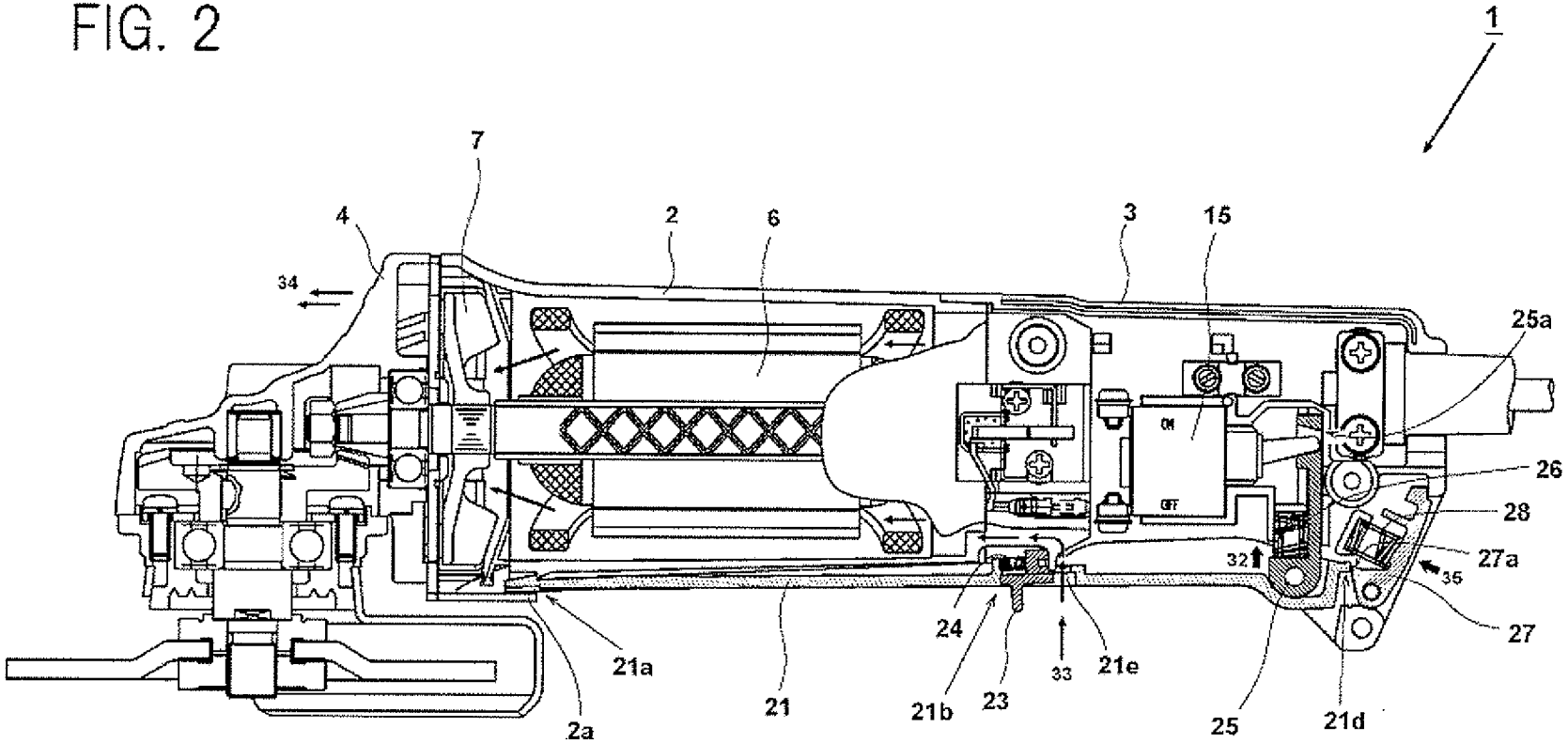
FIG. 2 is a sectional view showing the whole configuration of the disk grinder 1 according to the embodiment of the invention, and is the view showing a state of gripping a switch lever 21.

A state of gripping this switch lever 21 is shown in FIG. 2. In FIG. 2, the switch lever 21 moves upward when the worker grips the switch lever 21. When the switch lever 21 moves upward, the push bar 25 moves to the upper side as shown by an arrow 32 while compressing the spring 26, and the hole part 25*a* formed in the push bar 25 similarly moves to the upper side, so that the lever 16 is swung to the upper side and the switch 15 changes to an on state.

Figure 3:
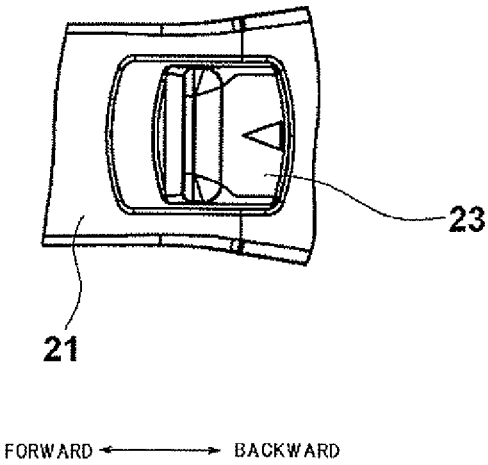
FIG. 3 is a partial bottom view in the case of viewing the switch lever 21 of FIG. 1 from the lower side (the time of turning off a switch).
Figure 4:
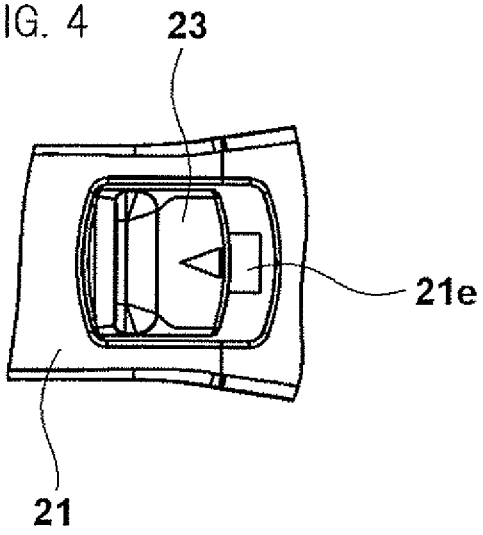
FIG. 4 is a partial bottom view in the case of viewing the switch lever 21 of FIG. 1 from the lower side (the time of turning on the switch).

In the embodiment, a hole 21*e* bored in the switch lever 21 is opened when the off-lock lever 23 is moved forward. FIGS. 3 and 4 are partial bottom views in the case of viewing this switch lever 21 from the lower side. FIG. 3 shows the case of positioning the off-lock lever 23 in a lock position, that is, the back side. Since the off-lock lever 23 closes the hole formed in the switch lever 21 at this time, a flow of air is not generated in the inside and outside of the switch lever 21. FIG. 4 shows the case of positioning the off-lock lever 23 in the front side (a state capable of moving the switch lever 21). As can be seen from the drawings, when the off-lock lever 23 is positioned in the front side, the hole 21*e* is opened and the inside and outside of the switch lever 21 communicate. As a result of this, an airflow as shown by an arrow 33 is generated through the hole 21*e* as shown in FIG. 2.

In FIG. 2, the air flowing into the housing portions (2, 3) as shown by the arrow 33 flows through the motor 6, and is sucked by the cooling fan 7, and is exhausted in a direction of arrow 34 from an air exhaust port (not shown) disposed in the gear cover 4. In addition, plural air intake ports (not shown) are formed in the tail cover 3, and the airflow flowing from the hole 21*e* bored in the switch lever 21 is added to airflows (not shown) flowing from the existing air intake ports. By disposing the hole 21*e* in the switch lever 21 thus, the air intake ports at the time of motor operation particularly necessary to cool the motor 6 can be increased.

An on-lock lever 27 for maintaining the switch 15 in the on state is disposed in the disk grinder 1 according to the embodiment. The on-lock lever 27 is provided for inhibiting return to the original position of the push bar 25 by positioning a pawl part 27*a* in the lower side of the fold back part 21*d* of the switch lever 21 by being pushed in a direction of arrow 35 when the push bar 25 moves in the direction of arrow 32 and the switch 15 is in the on state. In addition, the state shown in FIG. 2 shows a state while the on-lock lever 27 is pushed in the direction of arrow 35, and the pawl part 27*a* does not engage with the fold back part 21*d*. As described above, the disk grinder 1 has the on-lock lever 27, so that it is unnecessary for the worker to tightly grip the switch lever 21 during grinding work. When the on-lock lever 27 in the lock state is released, the on-lock lever 27 is again pushed in the direction of arrow 35 while tightly gripping the switch lever 21 and thereby, the pawl part 27*a* disengages from the fold back part 21*d* and the on-lock lever 27 returns to the original position by a spring 28.

In order to stop rotation of the motor 6, by releasing the switch lever 21 in a state of releasing a lock mechanism by the on-lock lever 27, the push bar 25 returns to the original position by a repulsive force of the spring 26 and thereby the switch lever 21 also returns to the position of FIG. 1. In this case, a state of contact between the rib 3*a* and the protrusion 23*a* of the off-lock lever 23 is released, so that the off-lock lever 23 returns to the original position shown in FIG. 1 by a repulsive force of the spring 24.

According to the embodiment as described above, the switch for turning on and off the motor is constructed of the inexpensive snap switch having the swing type lever, so that a cost of the electric power tool can be reduced. The swing type lever of the snap switch is completely received inside the housing, so that it is insusceptible to dust and a life of the switch can be increased. Further, the switch mechanism is constructed using the switch lever which is long in the forward and backward directions and can move in the direction substantially vertical to the lower surface (surface) of the tail cover 3, so that the easy-to-use switch mechanism can be implemented.

Second Embodiment

Figure 5:
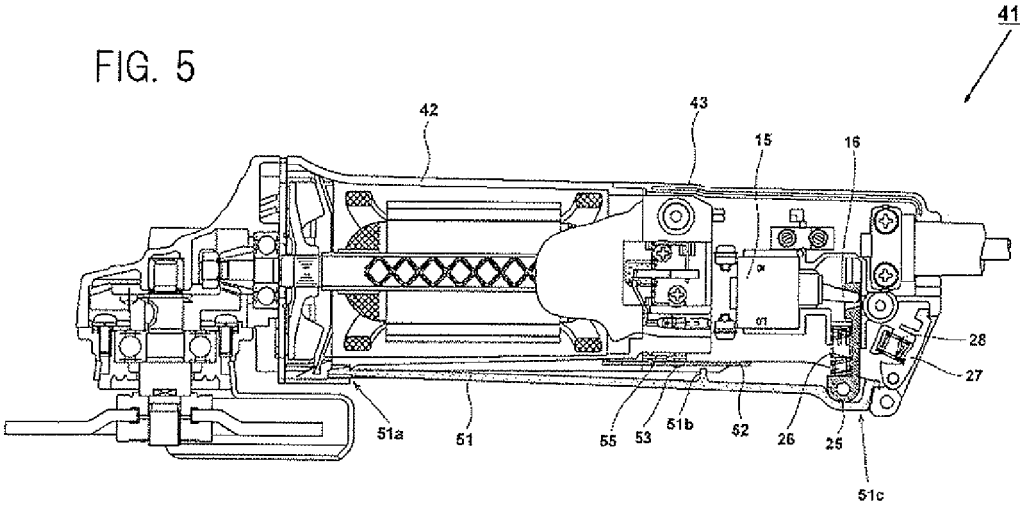
FIG. 5 is a sectional view showing the whole configuration of a disk grinder 41 according to a second embodiment of the invention.

Next, a second embodiment will be described with reference to FIGS. 5 to 7. In the second embodiment, a shape of a switch lever 51 is substantially the same as that of the switch lever 21 except for an on-lock lever part. The switch lever 51 can move in an upward direction from a state of FIG. 5 using the top side 51*a* as a fulcrum. In the present embodiment, an off-lock lever is not disposed in the switch lever 51, but a projection 51*b* with a round bar shape is disposed on the side facing housing parts (2, 3) in order to implement an off-lock mechanism. An off-lock dial 52 for rotating in a horizontal plane by a predetermined angle is provided in order to limit movement of the projection 51*b*. The off-lock dial 52 can turn around a rotating shaft 53. In order to return the off-lock dial 52 to an initial position (a rotational angle of 0°), a spring 54 of a torsion spring type is disposed between a motor housing 2 and the off-lock dial 52. An engaging part 51*c* for engaging with the lower side of a push bar 25 is formed in the back end side of the switch lever 51. The push bar 25, a spring 26, an on-lock lever 27 and a spring 28 are the same components as those of the example shown in the first embodiment, so that the repetitive description is omitted.

Figure 6:
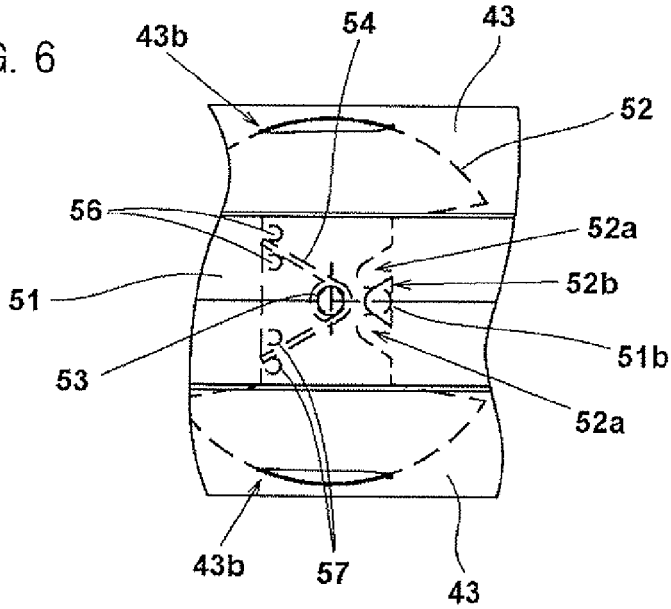
FIG. 6 is a partial bottom view in the case of viewing a tail cover 43 and a switch lever 51 of FIG. 5 from the bottom (the time of turning off a switch).

FIG. 6 is a partial bottom view in the case of viewing a tail cover 43 and the switch lever 51 from the bottom. The off-lock dial 52 capable of rotating about ±30° around the rotating shaft 53 is incorporated into the tail cover 43, and slits 43*b* are formed in two places of both of the right and left sides of the tail cover 43, and a portion of the off-lock dial 52 is exposed from the slits 43*b* to the outside. This exposed portion is formed in the two places of both of the right and left sides, and a worker can rotate the off-lock dial 52 by the predetermined angle. Two notched parts 52*a* and a stopper surface 52*b* formed between these notched parts are formed in a portion corresponding to the projection 51*b* of the off-lock dial 52. The stopper surface 52*b* inhibits upward movement of the switch lever 51 by abutting on the top of the projection 51*b*. FIG. 6 shows a state (an initial state of a rotational angle of)±0° in which the projection 51*b* abuts on the stopper surface 52*b* and in this state, the switch lever 51 cannot be moved in a direction in which a switch 15 is turned on. In the off-lock dial 52, the spring 54 of the torsion spring type is disposed between the motor housing 2 and the off-lock dial 52 in order to return the off-lock dial 52 to the initial position. Two retaining bosses 56 are disposed from the side of the motor housing 2 in order to fix one side of the spring 54. Further, two retaining bosses 57 are disposed in the off-lock dial 52 in order to fix the other side of the spring 54.

Figure 7:
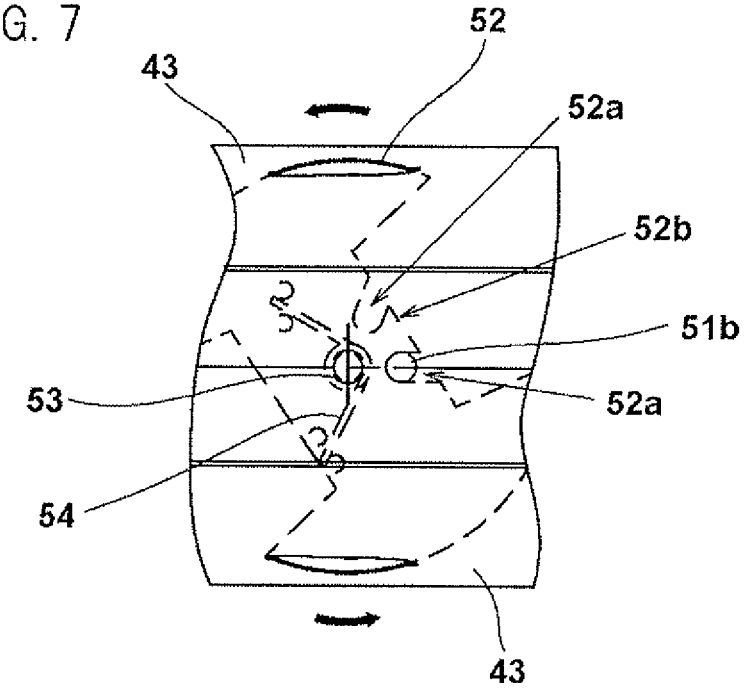
FIG. 7 is a partial bottom view in the case of viewing the tail cover 43 and the switch lever 51 of FIG. 5 from the bottom (the time of turning on the switch, the first).

FIG. 7 is a partial bottom view in the case of viewing the tail cover 43 and the switch lever 51 from the bottom, and shows a state of rotating the off-lock dial 52 by about 30°) (+30° in an arrow direction from the state of FIG. 6. By rotating the off-lock dial 52, the projection 51*b* is opposed to the notched part 52*a* and as a result, the upward movement of the switch lever 51 is enabled and the switch 15 can be turned on. In this case, a distance between two attachment parts becomes wide in the spring 54, so that the off-lock dial 52 returns to the original position (the initial position shown in FIG. 6) by the spring 54 in the case of opening the switch lever 51, with the result that an easy-to-use on-lock mechanism can be implemented.

Figure 8:
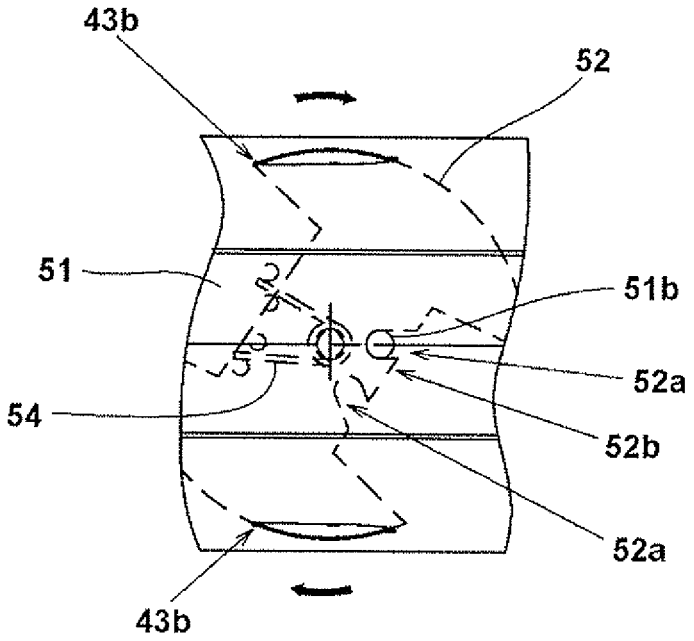
FIG. 8 is a partial bottom view in the case of viewing the tail cover 43 and the switch lever 51 of FIG. 5 from the bottom (the time of turning on the switch, the second).

FIG. 8 is a partial bottom view in the case of viewing the tail cover 43 and the switch lever 51 from the bottom, and shows a state of rotating the off-lock dial 52 by about 30°) (−30° in an arrow direction from the state of FIG. 6. By rotating the off-lock dial 52, the projection 51*b* is opposed to the notched part 52*a* and as a result, the upward movement of the switch lever 51 is enabled and the switch 15 can be turned on. In this case, the distance between the two attachment parts becomes narrow in the spring 54, so that the off-lock dial 52 returns to the original position (the initial position shown in FIG. 6) by the spring 54 in the case of opening the switch lever 51.

In the off-lock mechanism according to the second embodiment as described above, the switch lever 51 can be operated only when the off-lock dial 52 is rotated, so that an electric power tool for improving safety can be implemented. In addition, the embodiment provides the urging unit (spring 54) so that the rotated off-lock dial 52 returns to the original position, but may be constructed so that the worker rotates the off-lock dial 52 and returns the off-lock dial 52 to the original position (the state shown in FIG. 6) without providing the urging unit.

Third Embodiment

Figure 9:
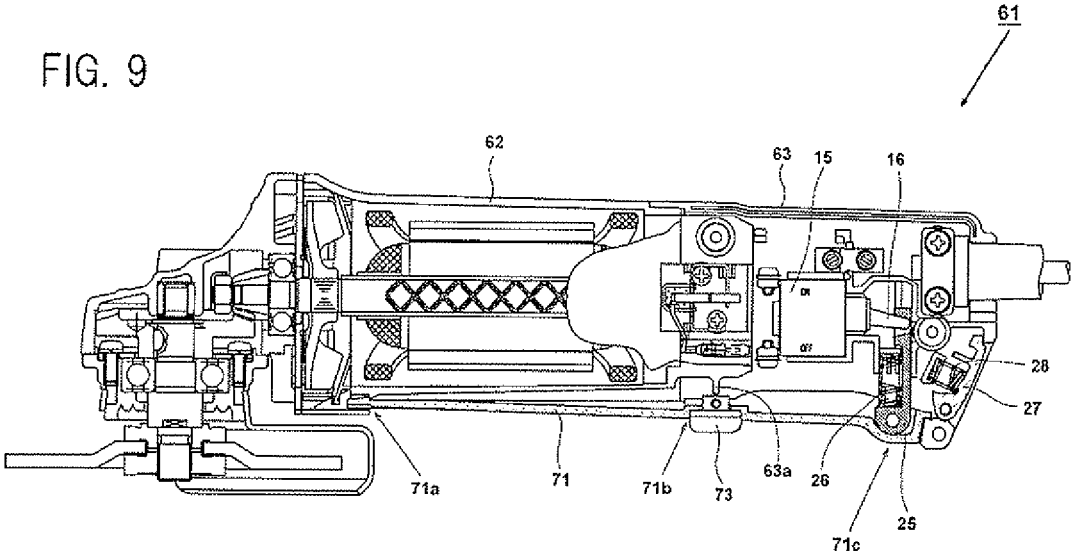
FIG. 9 is a sectional view showing the whole configuration of a disk grinder 61 according to a third embodiment of the invention.
Figure 10:
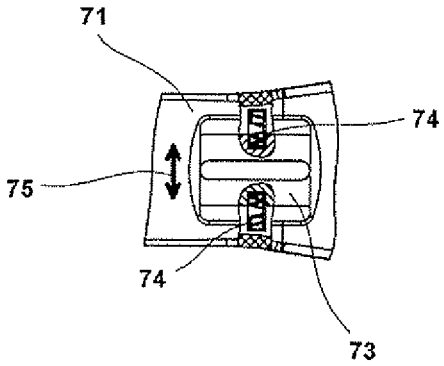
FIG. 10 is a partial bottom view in the case of viewing a switch lever 71 of FIG. 9 from the lower side, and shows a partially sectional view of the switch lever 71.

Next, a third embodiment will be described with reference to FIGS. 9 and 10. In the third embodiment, a shape of a switch lever 71 is similar to that of the switch lever 21 according to the first embodiment except for a shape of an off-lock lever 73 and a shape of a hole part 71*b* formed in the back slightly from the center of forward and backward directions. Here, a direction of movement of the off-lock lever 73 is a direction perpendicular to a direction of movement of a push bar 25 and is a direction perpendicular to a longitudinal direction (forward and backward directions) of the switch lever 71. FIG. 10 is a partial bottom view in the case of viewing the switch lever 71 from the lower side. The switch lever 71 has an initial position in the vicinity of the center of right and left directions in the hole part 71*b*. An arrow 75 showing a direction of movement of the switch lever 71 is impressed on the switch lever 71. In order to move the switch lever 21, the worker should first move the off-lock lever 73 in either direction (right or left direction) of the arrow 75 and then grip the switch lever 71. When the off-lock lever 73 is moved in either direction of the arrow 75 (not shown), a state of abutting of a rib 63*a* on a protrusion of the off-lock lever 73 is released and the switch lever 71 can be moved upward.

According to the third embodiment, in an on-lock mechanism according to the third embodiment, the direction of movement of the off-lock lever 73, which differs from that of the first embodiment, differs from the direction of movement of the switch lever 51, so that an electric power tool for improving safety can be implemented.

Fourth Embodiment

Figure 11:
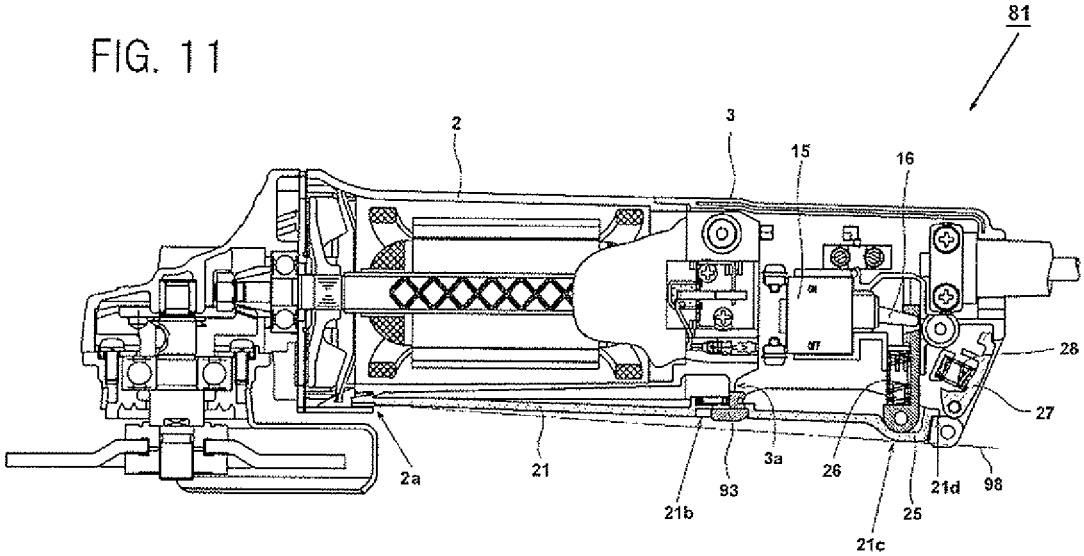
FIG. 11 is a sectional view showing the whole configuration of a disk grinder 81 according to a fourth embodiment of the invention.

Next, a fourth embodiment will be described with reference to FIGS. 11 and 12. In the fourth embodiment, the same reference numerals are assigned to the same components as those of the first embodiment shown in FIGS. 1 to 4. The present embodiment differs from the first embodiment in a shape of an off-lock lever 93. In the first embodiment, the protrusion 93*b* greatly protruding to the lower side which is a direction substantially perpendicular to the switch lever 21 is formed in the off-lock lever 23. This is because it is easy for a worker to hook the finger in the case of forward moving the off-lock lever 93. However, there are cases where a great projection downward from such a switch lever 21 is undesirable. Hence, in the present embodiment, a downward projection amount is decreased by forming the off-lock lever 93 with a shape as shown in FIG. 11. Since it becomes difficult to operate the off-lock lever 93 in the case the projection amount is decreased thus, the off-lock lever 93 is formed by a flexible material such as rubber or elastomer as the measures. In the embodiment, the amount of projection downward from the switch lever 21 is, for example, 5 mm or less.

Figure 12:
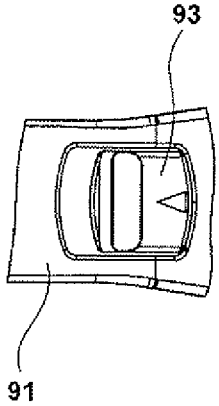
FIG. 12 is a partial bottom view in the case of viewing a switch lever 91 of FIG. 11 from the lower side.
Figure 13:
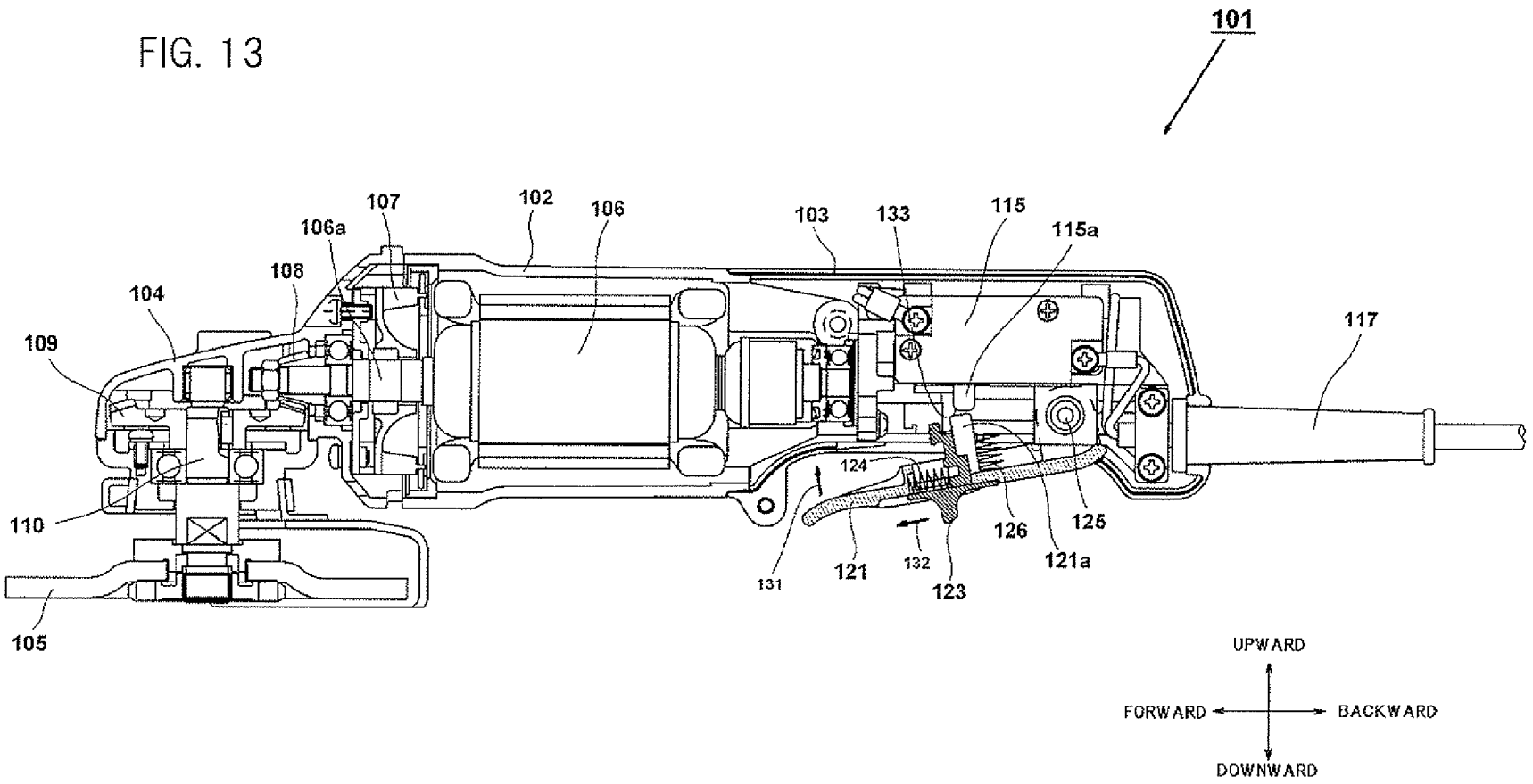
FIG. 13 is a sectional view showing the whole structure of a disk grinder 101 of a conventional example.
Figure 14:
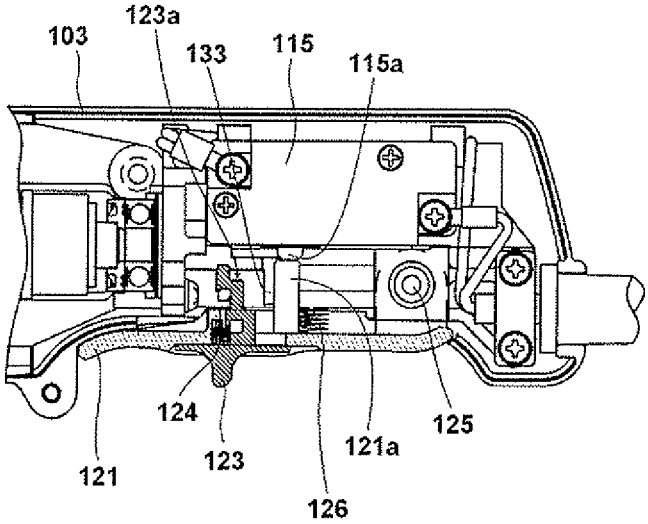
FIG. 14 is a partially sectional view showing a configuration of a switch part of the disk grinder 101 of the conventional example, and is the view showing a state of gripping a switch lever 121.

FIG. 12 is a partial bottom view in the case of viewing a tail cover 3 and the switch lever 21 in the embodiment from the bottom. The shape of the off-lock lever 93 is similar to the shape of the off-lock lever 23 of the first embodiment basically except for the projection portion, but the off lock lever 93 does not protrude from the switch lever 21 too much and has the flexible material. An engaging part 21*c* constructed as a portion of the switch lever 21 protrudes downward, but the off-lock lever 93 is arranged in a position which does not project from a straight line 98 (see FIG. 11) connecting a top part 21*a* and this engaging part 21*c*. Therefore, a good-looking electric power tool with a good feel of grip can be implemented. Also, the off-lock lever 93 is arranged in the position which does not project downward from the straight line connecting the top part 21*a* and the engaging part 21*c* of the off-lock lever 93, so that the risk of unexpected movement of the off lock lever 93 can be reduced drastically.

The exemplary embodiment has been described above, but the invention is not limited to the embodiments described above, and various changes can be made without departing from the gist of the invention. For example, the embodiments described above have been described using the disk grinder as an example of the electric power tool, but are not limited to this example, and any electric power tool for gripping a handle portion or a body of the housing and operating the motor can be implemented. Also, the direction of movement of the switch lever may be a parallel movement type or a swing or turn type.

What is claimed is:

1. An electric power tool comprising:

a motor including a rotating shaft;

a housing receiving the motor;

a power transmission mechanism configured to transmit a driving force of the motor to rotate a top tool;

a snap switch including a swing type lever configured to swing in a direction substantially perpendicular to the rotating shaft to turn on or off rotation of the motor, the snap switch being received inside the housing;

a switch lever configured to move in the direction substantially perpendicular to the rotating shaft;

a push bar configured to move the swing type lever in conjunction with the movement of the switch lever;

an urging unit configured to urge the push bar in a direction in which the switch is turned off; and an off-lock unit configured to limit movement of the switch lever in a direction in which the switch is turned on.

2. The electric power tool according to claim 1, wherein the off-lock unit includes a slide member disposed in the switch lever and a direction of movement of the slide member is substantially perpendicular to a direction of movement of the push bar.

3. The electric power tool according to claim 2, wherein the switch lever is provided with a second urging unit configured to return the slide member to a first position from a second position.

4. The electric power tool according to claim 3, wherein the switch lever is provided with a hole for communicating outside air to the inside of the housing when the slide member of the off-lock unit is located at a release state position.

5. The electric power tool according to claim 1, wherein the housing has a long tube shape and the switch lever has a long plate shape arranged in parallel with a longitudinal direction of the housing, and the push bar is arranged so that a longitudinal direction of the push bar coincides with a direction of movement of the switch lever.

6. The electric power tool according to claim 1 further comprising an on-lock unit configured to hold a movement position of the push bar when the switch lever is moved to change the switch to an on state.

7. The electric power tool according to claim 1, wherein the switch lever includes a swing fulcrum disposed in one end side of the switch lever and an engaging part which is engaged with the push bar and is disposed in the other end side of the switch lever, and the switch lever is rotated around the swing fulcrum by a minute distance.

8. An electric power tool comprising:

a motor including a rotating shaft;

a housing receiving the motor, the housing defining a front side and a back side;

a gear cover connected to the front side of the housing;

a spindle which protrudes from the gear cover, is rotated and driven by the motor and is configured to hold a top tool;

a snap switch received in the housing and disposed at the back side of the housing, the snap switch including a swing type lever configured to swing in a direction substantially perpendicular to the rotating shaft to turn on or off rotation of the motor; and a switch lever which extends in a direction from the front side to the back side of the housing and is configured to turn with respect to the housing to operate the snap switch and move in the direction substantially perpendicular to the rotating shaft to operate the snap switch.

9. An electric power tool comprising:

a motor including a rotating shaft;

a housing receiving the motor, the housing defining a front side and a back side;

a gear cover connected to the front side of the housing;

a spindle which protrudes from the gear cover and is rotated and driven by the motor and can hold a top tool;

a switch received in the housing and disposed at the back side of the housing;

a switch lever supported in the housing and configured to turn with respect to the housing to operate the switch and move in a direction substantially perpendicular to the rotating shaft to operate the switch; and an urging member configured to urge the switch and disposed between the housing and the switch lever.

10. An electric power tool comprising:

a motor including a rotating shaft;

a housing receiving the motor;

a power transmission mechanism configured to transmit a driving force of the motor to rotate a top tool;

a snap switch including a swing type lever configured to swing in a direction substantially perpendicular to the rotating shaft to turn on or off rotation of the motor, the snap switch being received inside the housing;

a switch lever configured to move in the direction substantially perpendicular to the rotating shaft;

a push bar configured to move the swing type lever in conjunction with the movement of the switch lever; and an urging unit configured to urge the push bar in a direction in which the switch is turned off;

wherein, the push bar includes a hole through which the swing type lever is passed.

11. The electric power tool according to claim 10, wherein the housing has a long tube shape and the switch lever has a long plate shape arranged in parallel with a longitudinal direction of the housing, and the push bar is arranged so that a longitudinal direction of the push bar coincides with a direction of movement of the switch lever.

12. The electric power tool according to claim 10 further comprising an on-lock unit configured to hold a movement position of the push bar when the switch lever is moved to change the switch to an on state.

13. The electric power tool according to claim 10, wherein the switch lever includes a swing fulcrum disposed in one end side of the switch lever and an engaging part which is engaged with the push bar and is disposed in the other end side of the switch lever, and the switch lever is rotated around the swing fulcrum by a minute distance.

* * * * *